US005911853A

United States Patent [19]

Borrel

[11] Patent Number: 5,911,853

[45] Date of Patent: Jun. 15, 1999

[54] METHOD FOR TREATING PAPER MILL CONDENSATE TO REDUCE THE AMOUNT OF SULFUR COMPOUNDS THEREIN

[75] Inventor: René Borrel, Shreveport, La.

[73] Assignee: International Paper Company, Purchase, N.Y.

[21] Appl. No.: 08/927,906

[22] Filed: Sep. 11, 1997

[51] Int. Cl.[6] ..... D21C 11/10; C02F 1/66

[52] U.S. Cl. ..... 162/15; 162/29; 60/641.5; 210/750

[58] Field of Search ..... 162/15, 29, 30.1, 162/30.11; 210/714, 718, 747, 790, 749, 750, 928; 60/641.5, 641.2

[56] References Cited

U.S. PATENT DOCUMENTS

| | | | |
|---|---|---|---|
| 3,414,038 | 12/1968 | Laakso | 162/15 |
| 3,650,888 | 3/1972 | Fogman et al. | 162/30 |
| 4,113,553 | 9/1978 | Samuelson | 162/34 |
| 4,148,684 | 4/1979 | Farin | 162/36 |
| 4,253,911 | 3/1981 | Hillstrom et al. | 162/30 |
| 4,299,652 | 11/1981 | Masuno et al. | 162/30 |
| 4,402,713 | 9/1983 | Domahidy | 55/53 |
| 4,410,432 | 10/1983 | Domahidy | 210/750 |
| 4,431,617 | 2/1984 | Farin | 423/232 |
| 4,511,376 | 4/1985 | Coury | 55/36 |
| 4,522,728 | 6/1985 | Gallup et al. | 210/714 |
| 4,526,773 | 7/1985 | Weber | 423/573 |
| 5,429,717 | 7/1995 | Bokstrom et al. | 162/60 |

FOREIGN PATENT DOCUMENTS

WO 96/23566 8/1996 WIPO .

*Primary Examiner*—Stanley S. Silverman
*Assistant Examiner*—Dean T. Nguyen
*Attorney, Agent, or Firm*—Luedeka, Neely & Graham, P.C.

[57] ABSTRACT

The invention described in the specification is a method for removing hydrogen sulfide, volatile mercaptans and methyl sulfides from a paper mill condensate stream. In the method, carbon dioxide is injected into the condensate stream under pressure and the pressure of the resulting $CO_2$-enriched condensate is reduced rapidly to a pressure sufficient to cause hydrogen sulfide and volatile mercaptans to pass from the $CO_2$-enriched condensate to a gas phase. The gas phase containing hydrogen sulfide and mercaptans may then be recycled or burned and the treated condensate may be recycled for pulp washing. The method is very cost effective and can be easily retrofitted into existing paper mill systems without significant capital expenditures or production down time.

23 Claims, 2 Drawing Sheets

METHOD FOR TREATING PAPER MILL CONDENSATE TO REDUCE THE AMOUNT OF SULFUR COMPOUNDS THEREIN

FIELD OF THE INVENTION

The invention relates to methods for reducing the concentration of hydrogen sulfide and mercaptans in paper mill condensate streams.

BACKGROUND

Paper mills which use sulfate and kraft pulping processes often generate large quantities of condensate streams containing undesirable compounds such as hydrogen sulfide, mercaptans, crude sulfate turpentine, methanol and red oil. Many of these compounds exhibit noxious odors even at extremely low concentrations and the presence of significant amounts of these compounds in the condensate detracts from the recyclability of the streams including use of the streams for wash water make-up. Accordingly, the condensate streams containing these compounds are not readily recyclable and often find little utility.

Because the aforementioned compounds which cause problems are present in the condensate at relatively low concentrations, it is difficult and expensive to further reduce the concentration of these compounds to a level which will not be deleterious. Existing methods which attempt to reduce the concentration of such compounds in condensate streams often result in increasing the sulfur content of the liquid and produce waste streams that permit too much soda carry-over through the wash step with an attendant economic penalty.

It is therefore an object of the invention to provide a cost effective method for treating paper mill condensate streams containing low concentrations of odorous compounds to enhance their recyclability for various uses including pulp washing.

Another object of the invention is to provide a process for reducing the amount of hydrogen sulfide and mercaptans in paper mill condensate streams.

Still another object of the invention is to provide a method for treating paper mill condensate streams without increasing the sulfur or chloride content thereof.

SUMMARY OF THE INVENTION

With regard to the above and other objects and advantages, the invention provides a method for treating paper mill condensate streams containing hydrogen sulfide, volatile mercaptans and methyl sulfides consisting essentially of contacting the paper mill condensate stream with an amount of carbon dioxide sufficient to produce a $CO_2$-enriched condensate stream having a pH below about 6.5 and reducing the pressure of the $CO_2$-enriched condensate stream to a pressure sufficient to cause a substantial portion of the hydrogen sulfide and mercaptans to pass from the $CO_2$-enriched stream to a gas phase.

By "substantial portion" it is meant a sufficient amount of these substances to render the treated condensate useful as wash water or wash water make-up for pulp washing. In general, removal of at least about 90% of these substances in a condensate stream contaminated by the presence of the substances in the several hundred ppm range will be sufficient. As used herein, "volatile mercaptans" means mercaptans having a boiling point below about 10° C. "Methyl Sulfides" include, but are not limited to, dimethyl disulfide and dimethyl sulfide.

In another aspect the invention provides a process for treating a paper mill condensate stream containing hydrogen sulfide, volatile mercaptans and methyl sulfides having a pH ranging from about 6.9 to about 12 flowing through an elongate flow conduit which consists essentially of contacting the paper mill condensate stream in the flow conduit with gaseous carbon dioxide for a time sufficient to reduce the pH of the stream to below about 6.5 and to produce a $CO_2$-enriched condensate stream, conducting the $CO_2$-enriched condensate stream from the flow conduit to a flash vessel and reducing the pressure of the stream in the flash vessel to a pressure sufficient to cause hydrogen sulfide and mercaptans to be released from the stream to a gas phase.

An advantage of the invention is that methods carried out according to the invention do not require expensive, complicated equipment such as carbonation towers and the like and the attendant losses of useful material therefrom. Furthermore, the methods do not significantly increase the sulfur or chloride content of the stream being treated and the nature of the resulting treated stream, particularly the pH of the stream, enables direct use of the same as a pulp washing medium which is effective to reduce soda carry-over into subsequent pulp treatment processes.

The process according to the invention has applicability to a wide variety of sulfur-contaminated condensate streams in a paper mill environment including, but not limited to, black liquor evaporator condensate, evaporator surface condenser condensate, condensate from turpentine condensers, condensate from the wood chip blow tank and the like.

BRIEF DESCRIPTION OF THE DRAWINGS

Other features and advantages of the invention will now be further described in the following detailed description of a preferred embodiment of the invention considered in conjunction with the drawings in which.

DETAILED DESCRIPTION OF THE INVENTION

Figure 1:
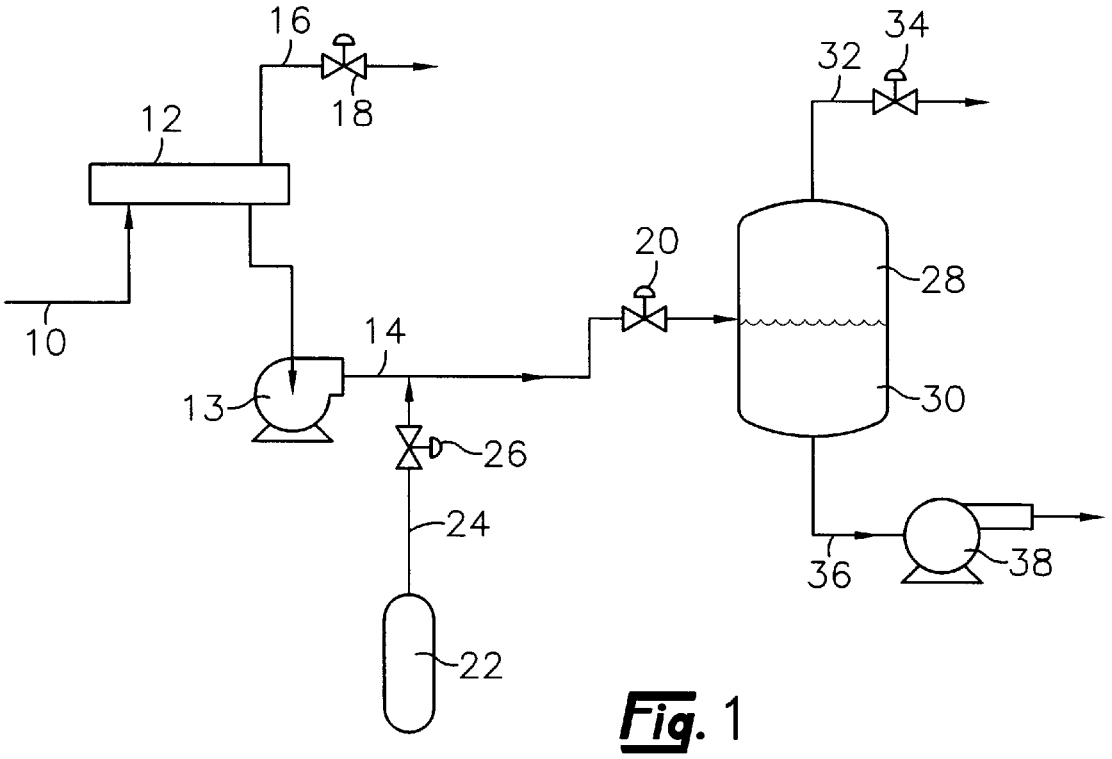
FIG. 1 is a schematic flow diagram of one method according to the invention for treating a paper mill condensate to reduce the hydrogen sulfide and volatile mercaptan concentration thereof.

With reference to FIG. 1, a stream in conduit 10 from a paper mill operation such as a black liquor evaporator/condenser containing water vapor and compounds such as hydrogen sulfide, methyl mercaptan, crude sulfate turpentine, methanol, red oil, dimethyl sulfide, dimethyl disulfide and the like is conducted to a condenser 12 for producing an aqueous condensate containing one or more of these sulfur-containing compounds in dissolved/dispersed form at relatively low concentrations ranging from about a few hundred ppm to less than 100 ppm. The pH of the condensate typically ranges from about 6.9 to about 12 and the condensate is collected and transferred by condensate pump 13 through conduit 14 for further treatment according to the invention, recycle or disposal. Non-condensible gases are vented from the condenser 12 through conduit 16 and control valve 18. The non-condensible gases may be burned or otherwise treated and/or vented to the atmosphere.

Preferably, control valve 20 in combination with condensate pump 13 maintains a pressure in conduit 14 so that the pressure of the condensate stream flowing in conduit 14 is above about 30 psig.

A source of pressurized carbon dioxide gas 22 provides carbon dioxide through conduit 24 and control valve 26 into conduit 14 downstream of condensate pump 13. The carbon dioxide is preferably sparged into the condensate stream in conduit 14 using an in-line sparging device to create minute bubbles of carbon dioxide having a bubble diameter below about 5000 microns and/or an in-line mixer downstream of a carbon dioxide injection point in the conduit in order to dissolve a sufficient quantity of carbon dioxide in the stream to lower the pH of the stream to below 6.5, preferably to a pH in the range of from about 5.0 to about 6.1. Lower pH's may be used, however, at too low a pH, exotic or expensive materials of construction for the conduits, valves and vessels may be required to limit corrosion.

The amount of carbon dioxide added to the condensate on a weight basis will vary depending principally on the initial pH, total alkalinity and temperature of the condensate. However, typically about 1 to about 1.25 pounds of carbon dioxide under a pressure of 45 psig or higher is sufficient to lower the pH of about 300 to about 320 gallons of condensate at about the same pressure to the desired range. In order to supply the needed amount of carbon dioxide into the condensate flowing in conduit 14, there must be a sufficient pressure differential between the pressure of the condensate stream and the carbon dioxide pressure at the point the carbon dioxide is introduced into the condensate stream. It is preferred that the carbon dioxide pressure be at least about 3 up to about 5 psi higher than the condensate stream pressure. If the differential pressure between the carbon dioxide pressure and the condensate stream pressure is much higher than about 5 psi, the carbon dioxide may be less effective for treating condensate streams containing hydrogen sulfide, volatile mercaptan and methyl sulfides.

The $CO_2$-enriched condensate stream in conduit 14 is conducted to a flash vessel 26 through control valve 28 where the pressure of the stream is rapidly reduced to an pressure sufficient to cause a substantial amount of the hydrogen sulfide and volatile mercaptans to pass from the treated condensate 30 in the vessel to a gas phase. Generally speaking, it will be sufficient to reduce the pressure to about or slightly above atmospheric pressure or 0 psig.

The temperature of the condensate is not believed to be critical to the invention and may vary within wide limits provided the temperature is not such that an excessive amount of carbon dioxide applied to conduit 14 is required to reduce the pH to the desired range. Condensate temperatures in the range of from about 18° to about 99° C. are believed to be suitable.

A gaseous stream or vapor phase containing hydrogen sulfide, volatile mercaptans and possibly an amount of carbon dioxide is collected from the treated condensate 30 and vented from the vessel 26 through conduit 32 and control valve 34 for further processing, recycle or disposal. The treated condensate 30 having a substantially reduced concentration of dissolved hydrogen sulfide, volatile mercaptans, and other volatile sulfurous components is fed from vessel 26 through conduit 36 to pump 38 for recycle, further treatment or disposal. In particular, the treated condensate substantially freed of hydrogen sulfide and volatile mercaptans and at a substantially reduced pH below about 6.5 may be used for effluent pH control or directly recycled for pulp washing, and is especially useful in washing blown pulp from a digester prior to beating, refining and/or bleaching operations. As a part of the filtrate from such washing operations, the treated condensate and collected material such as lignin components etc. may then be combined with black liquor and passed back to the evaporator/condensers from which it came. Accordingly, the invention accomplishes a highly efficient recycle of previously difficult to deal with paper mill condensate streams containing appreciable malodorous and noxious sulfur compounds.

Figure 2:
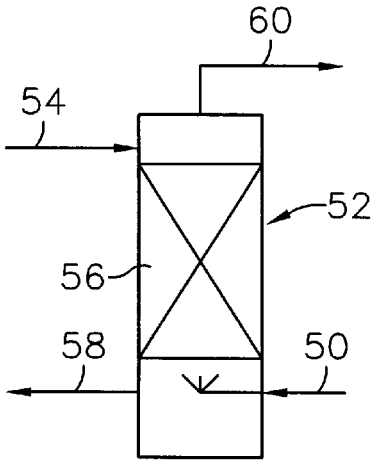
FIG. 2 is a contact tower for increasing sulfur content of a white or green liquor stream in accordance with one aspect of the invention.

Because the gaseous stream in conduit 32 is typically rich in hydrogen sulfide and mercaptans, it may be used to increase the sulfur content of a white liquor or green liquor stream in a pulp mill. With reference to FIG. 2, the gaseous stream containing hydrogen sulfide and mercaptans may be conducted via conduit 50 into the bottom of a packed column 52 wherein it contacts a liquid stream in a countercurrent manner. The liquid stream may be white liquor or green liquor fed into the top of the packed column through conduit 54 so that it flows through packed section 56 in countercurrent contact with the gaseous stream containing hydrogen sulfide and mercaptans which enters the packed column through conduit 50. An enriched white or green liquor stream is removed from the packed column through conduit 58, and is collected for use in the pulping or bleaching process of a paper mill. Non-condensible gases and excess hydrogen sulfide or mercaptans may be vented through conduit 60 to the black liquor recovery boiler.

Thus, the invention provides for recyclability of the treated condensate liquid component as well as the devolved sulfur-laden gases, promoting the concept of a closed mill. In this regard, reference is made to the process flow diagram of FIG. 3 which illustrates the usefulness of the invention in the recycle context relative to the cooking and black liquor operations for a typical kraft process. As shown, wood chips which are typically about 0.5 to about 1 inch long, about 0.25 to about 2 inches wide and about 0.25 inches thick are conducted through conduit 66 into a digester 70. White liquor containing NaOH and $Na_2S$ is conducted through conduit 68 into the digester 70. A typical weight ratio of white liquor to chips is about 2.5 to about 3.5 pounds of liquor per pound of wood on a dry basis. The total active alkali, expressed as $Na_2O$ per 100 grams of oven dried wood, may range from about 12.5% to about 20% by weight, however the ratio of NaOH to $Na_2S$ may vary widely from mill to mill. The alkali concentration of the white liquor may be controlled during the cooking cycle by various means known to those of ordinary skill.

Once the wood chips and cooking liquor are in the digester, the chips are cooked at an elevated temperature and pressure generally for from about 15 to about 150 minutes. The sulfide ion in the cooking liquor accelerates the rate of delignification of the wood chips producing delignified chips. The sulfide ion also combines with hydrogen ions and methyl radicals generated during the delignification process to produce small but objectionable quantities of hydrogen sulfide, volatile and non-volatile mercaptans, organic sulfides and disulfides which dissolve and/or disperse in the cooking liquor.

The spent cooking liquor known as weak black liquor containing lignin, hydrogen sulfide and organo-sulfur compounds is removed from the digester 70 through conduit 71 to a flash tank 72 where the pressure is reduced to about 0 to about 15 psig and the liquor is cooled to about 80° C. Steam and/or water vapor are generated as the pressure of the weak black liquor is reduced in the flash tank 72, and the steam and/or water vapor are conducted to the digester 70 through conduit 89 for heat recovery purposes. At this point in the process, the weak black liquor contains from about 8 to about 16 percent by weight solids.

From the flash tank 72, the weak black liquor is conducted through conduit 73 to a weak black liquor storage vessel 74 for processing in multiple effect evaporators 76 which are used to concentrate the black liquor from about 18 wt. % to about 60 wt. % to produce a heavy black liquor which is conducted by conduit 77 to black liquor vessel 78. The heavy black liquor is typically burned in a recovery boiler to generate steam and to reduce the volume of solids which mush be landfilled.

The overhead vapors from evaporators 76 are condensed in condensers 80 at a temperature of about 53° C. Because the hydrogen sulfides, methyl mercaptans, methyl sulfides and disulfides are relatively volatile, a significant amount of sulfides and mercaptans will be carried with the condensible vapors from the first effect evaporator or evaporator hot well into condenser 80 where such sulfur-laden compounds will dissolve in the condensed liquid phase.

According to the process of the invention, sulfur compounds are substantially removed from the condensate stream by contacting the condensate in conduit 82 with carbon dioxide under pressure from a carbon dioxide source 84 through contactor 85 as previously described. The $CO_2$-enriched condensate stream is then conducted to a flash vessel 86 where the pressure is rapidly reduced from about 30 to about 60 psig down to about 0 to about 25 psig or lower in order to cause the hydrogen sulfide and methyl mercaptans to pass from the $CO_2$-enriched condensate stream to a gas phase.

Figure 3:
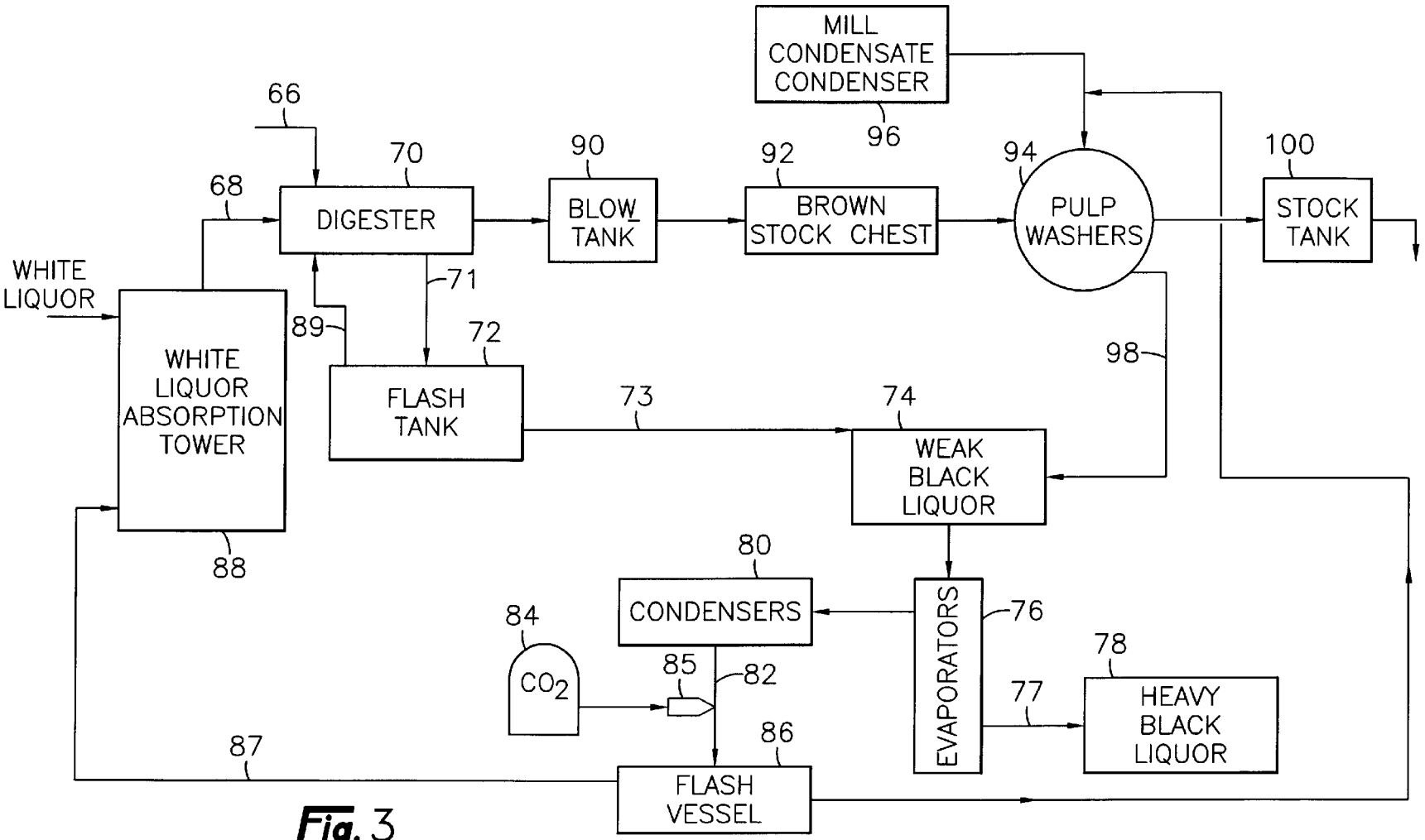
FIG. 3 is a block flow diagram of a pulp cooking and black liquor treatment system using carbon dioxide treatment according to the invention.

The gaseous stream in conduit 87 from flash vessel 86 may be conducted to a recovery boiler, kiln, incinerator or, as shown in FIG. 3, to a white liquor absorption tower 88 wherein the sulfur concentration of the white liquor is increased by countercurrent contact with the gaseous stream from flashed vessel 86.

Digested wood chips from digester 70 are passed to blow tank 90 wherein the chips disintegrate into individual wood fibers as the pressure is rapidly reduced to from about 150 psig to about 3 psig. Wood fibers from the blow tank are conducted to a brown stock chest 92 which feeds the pulp washers 94. Typically, the shower water for the pulp washers 94 comes from fresh water, well water, and clean condensers 96 which do not contain significant amount of noxious sulfur compounds. Washings from washers 94 are passed in conduit 98 to vessel 74 and then processed as part of the black liquor. The washed pulp is collected in the stock tank 100 for further processing, bleaching and eventual use in a papermaking furnish.

According to the invention, the treated condensate in flash vessel 86 derived from the $CO_2$-enriched condensate stream may be used as a wash liquid and/or make-up liquid in the pulp washers 94 since the condensate, as a result of carbon dioxide treatment, contains sufficiently low amounts of noxious sulfur compounds and an appropriate pH to make it useful for pulp washing at this stage of the pulp preparation process.

The following nonlimiting example demonstrates various aspects of the invention.

EXAMPLE

A contaminated condensate stream from a Louisiana paper mill processing softwood having a an initial pH of 8.7 and containing 336.0 ppm hydrogen sulfide, 223.0 ppm methyl mercaptan, 67.0 ppm dimethyl sulfide, 59.0 ppm dimethyl disulfide and 11,000 ppm methanol was placed in a 1 liter pressure bomb. The condensate was treated with carbon dioxide by injecting an amount of carbon dioxide into the bomb containing the sample to obtain pressures of 10, 20 40 and 60 psig and a pH of 5.6. The pressure was maintained for 30 minutes at a temperature of 70° C. to determine the effect of carbon dioxide treatment pressure on the removal efficiency of sulfur compounds from the condensate. The vessel was continuously stirred during the carbon dioxide treatment. At the end of 30 minutes, the vessel was rapidly depressurized to atmospheric pressure and the condensate was analyzed by gas chromatography to determine the level of sulfur compounds and methanol remaining in the condensate. Results of the carbon dioxide treatment are given in the following table in Runs 1–5.

In run 6, a 5 gallon contaminated condensate sample from a paper mill containing 15 ppm hydrogen sulfide, 10 ppm methyl mercaptan, and 3.4 ppm dimethyl disulfide and having an initial pH of 8.8 was pumped through a conduit while maintaining the condensate at a pressure of 30 psig and a temperature of 70° C. The condensate was treated by injecting a total of about 9 grams of carbon dioxide into the flowing condensate stream through a rotameter. The treated stream was conducted to an atmospheric vessel which was vented to remove hydrogen sulfide and mercaptans. The treated liquid had a final pH of 5.2 and was analyzed by gas chromatography to determine the amount of sulfur compounds remaining in the sample. The analysis of the treated stream of Run 6 is given in the following table.

| | Treatment | Analysis of Treated Condensate | | | | | |
|---|---|---|---|---|---|---|---|
| Run # | Pressure (psig) | pH | $H_2S$ (ppm) | MeSH[1] (ppm) | DMS[2] (ppm) | DMDS[3] (ppm) | MeOH (ppm) |
| 1 | no $CO_2$ used | 5.6 | 336.0 | 223 | 67.0 | 59.0 | 11,000 |
| 2 | 10 | 5.6 | 12.0 | 6.9 | 41.0 | 71.0 | 11,000 |
| 3 | 20 | 5.6 | 24.0 | 8.3 | 33.0 | 55.0 | 10,000 |
| 4 | 40 | 5.6 | 21.0 | 12.0 | 35.0 | 57.0 | 11,000 |
| 5 | 60 | 5.6 | 15.0 | 2.6 | 21.0 | 46.0 | 9,900 |
| 6 | 30 | 5.2 | 3.4 | 8.3 | none detected | none detected | not determined |

[1]MeSH is methyl mercaptan.
[2]DMS is dimethyl sulfide.
[3]DMDS is dimethyl disulfide.

The data in the above table illustrates that a significant reduction in hydrogen sulfide and methyl mercaptans was obtained by treating the condensate stream with carbon dioxide at pressures ranging from about 10 to about 60 psig. More than 95% of the hydrogen sulfide and mercaptans were removed from the condensate stream by using carbon dioxide at a pressure of about 60 psig. There was also more than 60% reduction in dimethyl sulfide, more than 20% reduction in dimethyl disulfide and about 10% reduction in methanol by contacting the condensate with carbon dioxide at 60 psig.

Having now described and illustrated preferred embodiments of the invention, it will be appreciated by those of ordinary skill that various modifications, rearrangements and substitutions may be made to the invention within the spirit and scope of the appended claims.

What is claimed is:

1. A method for treating paper mill condensate streams containing hydrogen sulfide, volatile mercaptans and methyl sulfides consisting essentially of contacting a flowing paper mill condensate stream having a pH above about 6.5 and a pressure above atmospheric pressure with an amount of gaseous carbon dioxide at a pressure higher than the pressure of the condensate stream sufficient to produce a $CO_2$-enriched condensate stream having a pH below about 6.5 and subsequently reducing the pressure of the $CO_2$-enriched condensate stream in a flash vessel to a pressure sufficient to cause a substantial portion of the hydrogen sulfide and mercaptans to pass from the $CO_2$-enriched stream to a gas phase and conducting the gas phase to an absorption tower or a recovery boiler.

2. The method of claim 1 wherein the pressure of the $CO_2$-enriched condensate stream is reduced to a pressure below about 30 psig.

3. The method of claim 1 wherein the carbon dioxide pressure ranges from about 3 to about 5 psi higher than the pressure of the condensate stream being contacted.

4. The method of claim 1 wherein the gas phase is conducted to an absorption tower and the method further comprises contacting a white liquor or green liquor with the gas phase in the absorption tower in order to increase the sulfur compound content of the white liquor or green liquor.

5. The method of claim 1 wherein the gas phase is conducted to a recovery boiler and the method further comprises burning the hydrogen sulfide and mercaptans in the gas phase in the recovery boiler.

6. The method of claim 1 wherein the condensate stream has a pH of from about 6.9 to about 12 at the time the condensate stream is contacted with carbon dioxide.

7. The method of claim 6 wherein the $CO_2$-enriched condensate stream has a pH within the range of from about 5.0 to about 6.1 after contacting the condensate stream with carbon dioxide.

8. The method of claim 1 wherein the treated condensate stream has a pH within the range of from about 5.0 to about 6.1 after contacting the condensate stream with carbon dioxide.

9. A process for treating a paper mill condensate stream containing hydrogen sulfide, volatile mercaptans and methyl sulfides and having a pH ranging from about 6.9 to about 12 flowing through an elongate flow conduit which consists essentially of contacting the paper mill condensate stream in the flow conduit with an amount of gaseous carbon dioxide at a pressure above the pressure of the condensate stream and for a time sufficient to reduce the pH of the stream to below about 6.5 and to produce a $CO_2$-enriched condensate stream, conducting the $CO_2$-enriched condensate stream from the flow conduit to a flash vessel and rapidly reducing the pressure of the condensate stream in the flash vessel to a pressure sufficient to cause hydrogen sulfide and mercaptans to be released from the stream to a gas phase.

10. The process of claim 9 wherein the condensate stream is contacted with carbon dioxide under a pressure ranging from above about 30 psig to about 100 psig.

11. The process of claim 10 wherein the carbon dioxide pressure ranges from about 3 to about 5 psi higher than a pressure of the condensate stream being contacted.

12. The process of claim 11 wherein the reduced pressure is a pressure less than about 30 psig.

13. The process of claim 10 further comprising collecting a gaseous stream containing the gas phase hydrogen sulfide and mercaptans from the flash vessel, conducting the gaseous stream to an absorption tower and contacting a white liquor or green liquor with the gaseous stream in a manner sufficient to increase the sulfur content of the white liquor or green liquor.

14. The process of claim 10 further comprising collecting a gaseous stream containing the gas phase hydrogen sulfide and mercaptans from the flash vessel, conducting the gaseous stream to a recovery boiler and burning the hydrogen sulfide and mercaptans in the recovery boiler.

15. The method of claim 10 wherein the $CO_2$-enriched condensate stream has a pH within the range of from about 5.0 to about 6.1 after contacting the condensate stream with carbon dioxide.

16. A pulping process for preparing cellulosic fibrous pulp for papermaking which comprises:

cooking wood chips in a digester using NaOH and $Na_2S$ to produce cooked chips and weak black liquor containing hydrogen sulfide, volatile mercaptans and methyl sulfides;

blowing the wood chips from the digester to a blow tank to disintegrate the wood chips into wood fibers;

washing the wood fibers on a pulp washer with a wash liquid to remove cooking liquors from the fibers into washings;

combining at least a portion of the washings with the weak black liquor;

concentrating the weak black liquor in a black liquor evaporator to produce concentrated black liquor and a vapor stream containing hydrogen sulfide, methanol, methyl mercaptans and methyl sulfides;

condensing at least a portion of the vapor stream in a condenser to produce a pressurized condensate stream having a pH above about 6.5 containing hydrogen sulfide, volatile mercaptans, methanol and methyl sulfides;

contacting the condensate stream an amount of carbon dioxide at a pressure above the pressure of the condensate stream and for a time sufficient to produce a $CO_2$-enriched condensate stream having a pH below about 6.5;

reducing the pressure of the $CO_2$-enriched condensate stream in a flash vessel to a pressure sufficient to cause a substantial portion of the hydrogen sulfide and mercaptans to pass from the $CO_2$-enriched stream to a gas phase and to produce a substantially sulfur compound-free treated condensate;

collecting a gaseous stream containing the gas phase;

conducting the gas phase to an absorption tower or a recovery boiler; and recycling the treated condensate for use as at least a portion of the wash liquid for washing the pulp.

17. The process of claim 16 wherein the pressure of the $CO_2$-enriched stream is reduced to a pressure less than about 30 psig.

18. The process of claim 17 wherein the carbon dioxide pressure ranges from about 3 to about 5 psi higher than the pressure of the condensate stream being contacted with carbon dioxide.

19. The process of claim 16 wherein the gaseous stream is conducted to an absorption tower and the method further comprises contacting a white liquor or green liquor with the gaseous stream in the absorption tower in order to increase the sulfur compound content of the white liquor or green liquor.

20. The process of claim 16 wherein the gaseous stream is conducted to a recovery boiler and the method further comprises burning the hydrogen sulfide and mercaptans in the gaseous stream in the recovery boiler.

21. The process of claim 16 wherein the condensate stream has a pH of from about 6.9 to about 12 at the time the condensate stream is contacted with carbon dioxide.

22. The process of claim 21 wherein the $CO_2$-enriched condensate stream has a pH within the range of from about 5.0 to about 6.1.

23. The process of claim 16 wherein the $CO_2$-enriched condensate stream has a pH within the range of from about 5.0 to about 6.1.

* * * * *

UNITED STATES PATENT AND TRADEMARK OFFICE

CERTIFICATE OF CORRECTION

PATENT NO. : 5,911,853

DATED : June 15, 1999

INVENTOR(S) : René Borrel

It is certified that error appears in the above-identified patent and that said Letters Patent is hereby corrected as shown below:

Column 3, line 39, change "26" to --28--.

Column 3, line 57, change "26" to --28--.

Column 3, line 62, change "26" to --28--.

Signed and Sealed this

Second Day of November, 1999

*Attest:*

*Attesting Officer*

Q. TODD DICKINSON

*Acting Commissioner of Patents and Trademarks*

UNITED STATES PATENT AND TRADEMARK OFFICE

CERTIFICATE OF CORRECTION

PATENT NO : 5,911,853

DATED : June 15, 1999

INVENTOR(S) : Rene Borrel

It is certified that error appears in the above-identified patent and that said Letters Patent is hereby corrected as shown below:

Column 3, line 39, after "vessel", delete "26" and insert --28--.
Column 3, line 39, after "valve", delete "28" and insert --20--.
Column 3, line 40, after "reduced to", delete "an" and insert --a--.
Column 3, line 56, after "vessel", delete "26" and insert --28--.
Column 3, line 61, after "vessel", delete "26" and insert --28--.
Column 3, line 63, after "substantially", delete "freed" and insert --free--.
Column 5, line 11, delete "mush" and insert --must--.
Column 5, line 38, after "reduced", delete "to".
Column 5, line 61, after "softwood having", delete "a".

In the Claims:

Claim 16, Column 8, line 23, after "stream" and before "an", insert --with--.

Signed and Sealed this

Twenty-eighth Day of December, 1999

Attest:

Q. TODD DICKINSON

Attesting Officer

Acting Commissioner of Patents and Trademarks